US009504297B2

(12) United States Patent
Pao

(10) Patent No.: US 9,504,297 B2
(45) Date of Patent: Nov. 29, 2016

(54) FOLDABLE CHAIR

(71) Applicant: Chih-Ting Pao, Taichung (TW)

(72) Inventor: Chih-Ting Pao, Taichung (TW)

( * ) Notice: Subject to any disclaimer, the term of this patent is extended or adjusted under 35 U.S.C. 154(b) by 0 days.

(21) Appl. No.: 14/812,665

(22) Filed: Jul. 29, 2015

(65) Prior Publication Data

US 2015/0327636 A1 Nov. 19, 2015

Related U.S. Application Data

(63) Continuation-in-part of application No. 14/289,120, filed on May 28, 2014, now abandoned.

(30) Foreign Application Priority Data

Oct. 23, 2013 (TW) ..... 102219730 U

(51) Int. Cl.
*A45B 5/00* (2006.01)
*A47C 4/04* (2006.01)

(52) U.S. Cl.
CPC .. *A45B 5/00* (2013.01); *A47C 4/04* (2013.01)

(58) Field of Classification Search
CPC ..... A45B 25/16; A45B 5/00
USPC ..... 135/66; 297/16.1, 16.2, 118, 183.5
See application file for complete search history.

(56) References Cited

U.S. PATENT DOCUMENTS 2,380,437 A * 7/1945 Homrighausen ..... A61H 3/00 297/118
2,629,429 A * 2/1953 Baumfeld ..... A47C 9/105 297/118
3,999,565 A 12/1976 Delacour et al.
8,997,766 B2 * 4/2015 Pao ..... A47C 4/04 135/66
2014/0034097 A1 * 2/2014 Pao ..... A45B 5/00 135/66
2014/0034098 A1 * 2/2014 Pao ..... A45B 5/00 135/66

FOREIGN PATENT DOCUMENTS

CN 102188115 A 9/2011
CN 103720148 A 4/2014
TW 143769 B 10/1990

OTHER PUBLICATIONS

Search Report issued to the PCT application No. PCT/CN2014/079572 by the State Intellectual Property Office of the P.R.C. on Mar. 11, 2015, with English translation of PCT/ISA/210 and an abridged English translation of PCT/ISA/237 (17 pages).
Search Report issued to European counterpart application No. 14189631.6 on Apr. 1, 2015 (3 pages).

* cited by examiner

*Primary Examiner* — Noah Chandler Hawk
(74) *Attorney, Agent, or Firm* — DLA Piper LLP (US)

(57) ABSTRACT

A foldable chair includes a stick shank, a collar sleeve movable between distal and proximate positions on the stick shank, a carrier sleeved on the stick shank, and a seat unit. The seat unit includes a middle portion pivotally connected to the collar sleeve, and left and right wing portions hinged to the middle portion. When the collar sleeve is displaced from the distal position to the proximate position, the seat unit is convertible from a use state, where middle portion is coplanar with the left and right wing portions, to a collapsed state, where the middle portion is at an included angle with each of the left and right wing portions.

20 Claims, 15 Drawing Sheets

FOLDABLE CHAIR

CROSS-REFERENCE TO RELATED APPLICATION

This application is a continuation-in-part (CIP) of co-pending U.S. patent application Ser. No. 14/289,120, filed on May 28, 2014, which claims priority of Taiwanese application no. 102219730, filed on Oct. 23, 2013.

FIELD

This disclosure relates to a foldable chair.

BACKGROUND

U.S. Pat. No. 2,380,437 discloses a crutch assembly which includes a crutch and a foldable seat. One problem with the crutch assembly is that when the seat is in its folded position, a mechanism for supporting the seat, such as supporting legs, etc., is not compactly folded and is exposed to the user, so that the user may easily get hurt by the folded supporting mechanism. U.S. Pat. No. 3,999,565 discloses a walking stick device in which a support member for supporting the wounded knee or leg is fastened to a standard/body in a retractable fashion. The walking stick device may encounter the similar problem.

SUMMARY

An object of the present disclosure is to provide a foldable chair in which a seat unit can be transformed from a use state to a collapsed state by virtue of a novel conversion mechanism. With the novel conversion mechanism, when a person uses the foldable chair of this disclosure with the seat unit in the collapsed state, he/she is less likely to get hurt by the foldable chair.

According to this disclosure, a foldable chair includes:

a stick shank extending in a lengthwise direction to terminate at a grip end and a foot end;

a collar sleeve sleeved on the stick shank and movable between distal and proximate positions relative to the grip end;

a carrier sleeved on the stick shank;

a seat unit including, a middle portion extending in a longitudinal direction to terminate at a forward edge and a rearward edge which is pivotally connected to the collar sleeve, and left and right wing portions each being juxtaposed with the middle portion along a hinge line, and each being hinged to the middle portion at the respective hinge line such that when the collar sleeve is displaced from the distal position to the proximate position, the seat unit is convertible from a use state, where the middle portion is coplanar with the left and right wing portions, to a collapsed state, where the middle portion is at an included angle with each of the left and right wing portions;

two keyways each being disposed on an under surface of a corresponding one of the left and right wing portions, and each extending along the longitudinal direction to terminate at front and rear keyway ends;

two bracing bars each having a pivot end pivotally connected to the carrier, and a key end configured to be slidably engaged with a corresponding one of the keyways such that when the key end slides from the front keyway end of a respective one of the keyways to the rear keyway end of the respective one of the keyways, the seat unit is converted from the use state to the collapsed state; and two prop legs each extending to terminate at a bottom end for standing on the ground, and a pivoted end pivotally connected to the carrier, the two prop legs being convertible between a straddling position, where the bottom ends of the prop legs are remote from the stick shank, and an upheld position, where the bottom ends are close to the stick shank such that when the collar sleeve is displaced from the distal position to the proximate position, the prop legs are permitted to move from the straddling position to the upheld position.

BRIEF DESCRIPTION OF THE DRAWINGS

Other features and advantages of the present disclosure will become apparent in the following detailed description of the embodiments of the disclosure, with reference to the accompanying drawings, in which.

DETAILED DESCRIPTION

Figure 1:
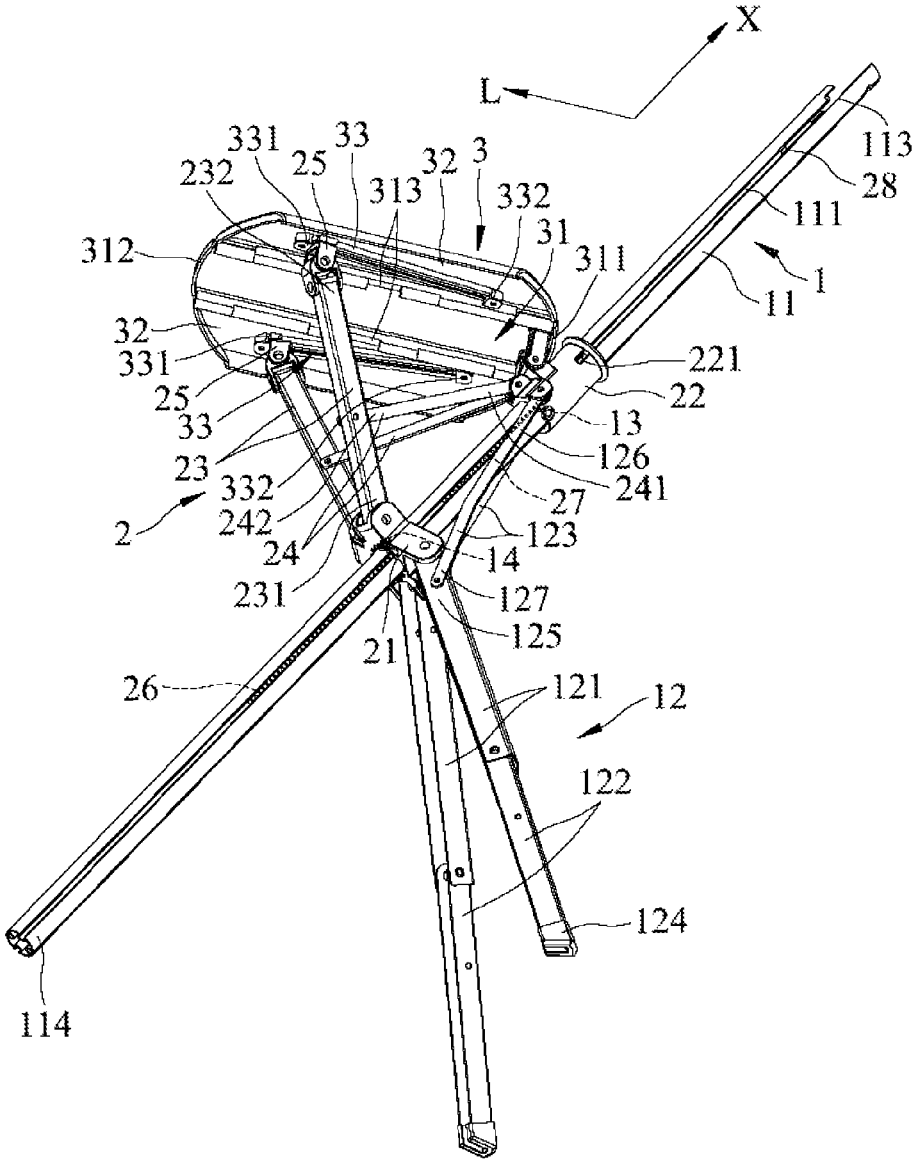
FIG. 1 is a perspective view of a foldable chair according to a first embodiment of this disclosure, where a seat unit of the foldable chair is in a use state.

Before the present disclosure is described in greater detail, it should be noted herein that same reference numerals are used to denote like elements throughout the specification.

Referring to FIGS. 1 to 7, a foldable chair according to a first embodiment of this disclosure is configured as a chair-convertible walking stick, and includes a supporting unit 1, a conversion mechanism 2, a seat unit 3, and first and second retaining members 13, 14. The supporting unit 1 includes a stick shank 11, a grip 112, and two prop legs 12. The conversion mechanism 2 includes a collar sleeve 22, a carrier 21, two keyways 33, and two bracing bars 23.

The stick shank 11 extends in a lengthwise direction (X) to terminate at opposite grip and foot ends 113, 114. The grip 112 is connected to the grip end 113.

The collar sleeve 22 is sleeved on the stick shank 11 and is movable between distal and proximate positions, relative to the grip end 113.

The carrier 21 is slidable on the stick shank 11, and is movable between an upper position, where the collar sleeve 22 is moved to the proximate position, and a lower position, where the collar sleeve 22 is moved to the distal position.

Figure 2:
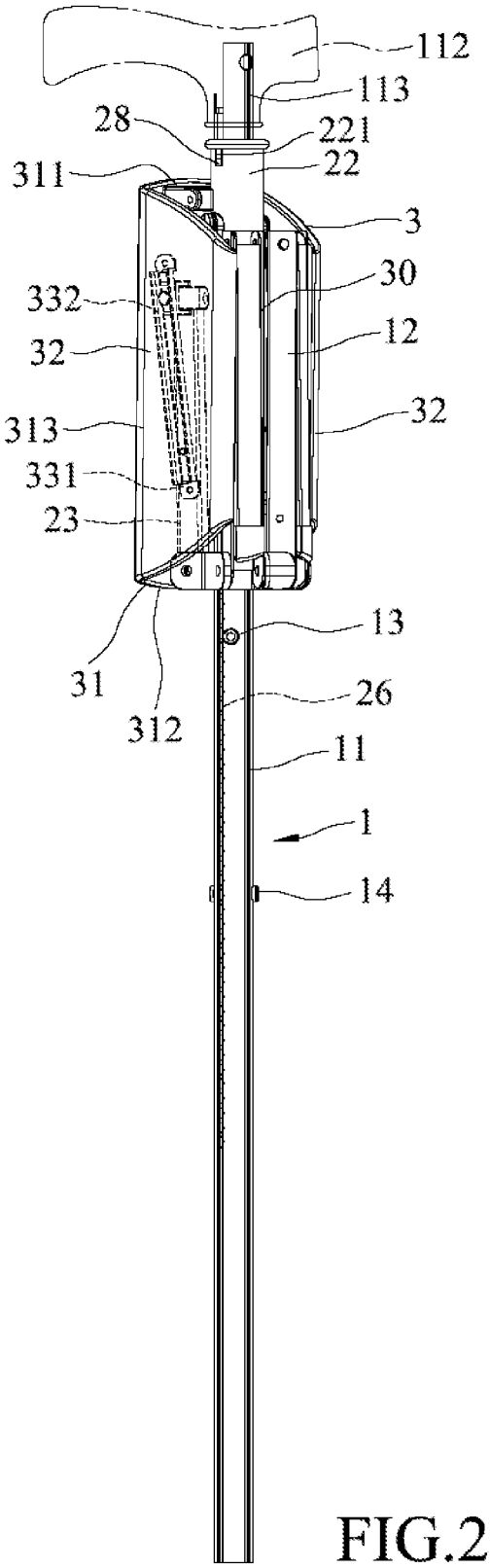
FIG. 2 is similar to FIG. 1, showing that the seat unit of the foldable chair is in a collapsed state.
Figure 3:
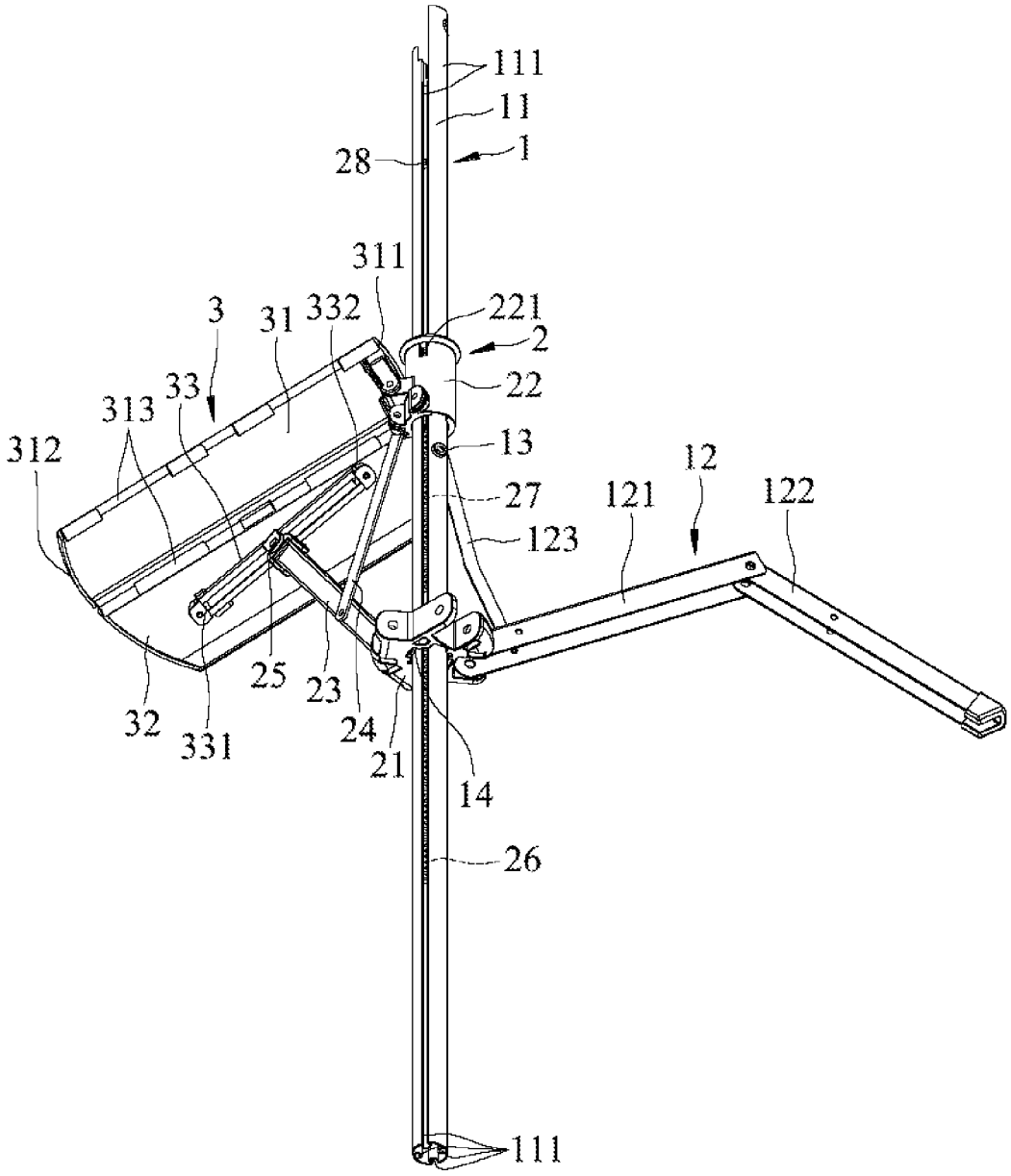
FIG. 3 is similar to FIG. 1, showing that the seat unit of the foldable chair is in a state between the use state and the collapsed state, some elements in the right side of the foldable chair being omitted for clarity.
Figure 4:
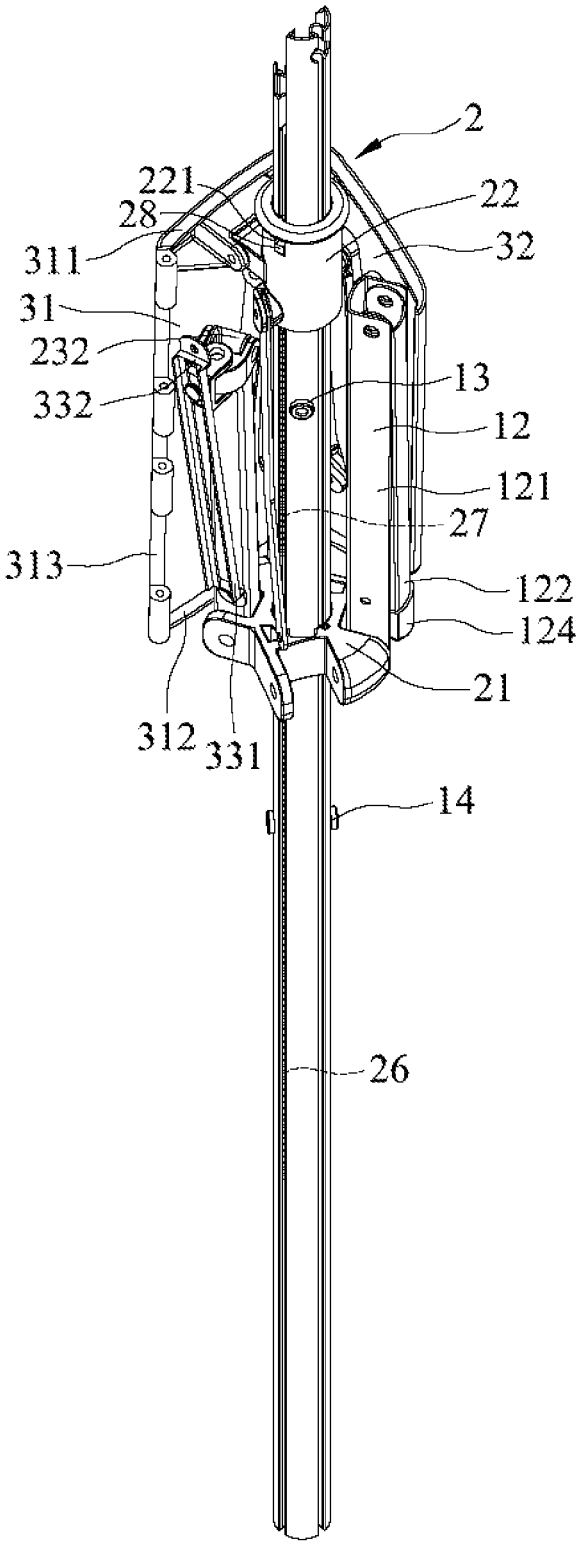
FIG. 4 is similar to FIG. 2 but with some elements in the right side of the foldable chair omitted.
Figure 5:
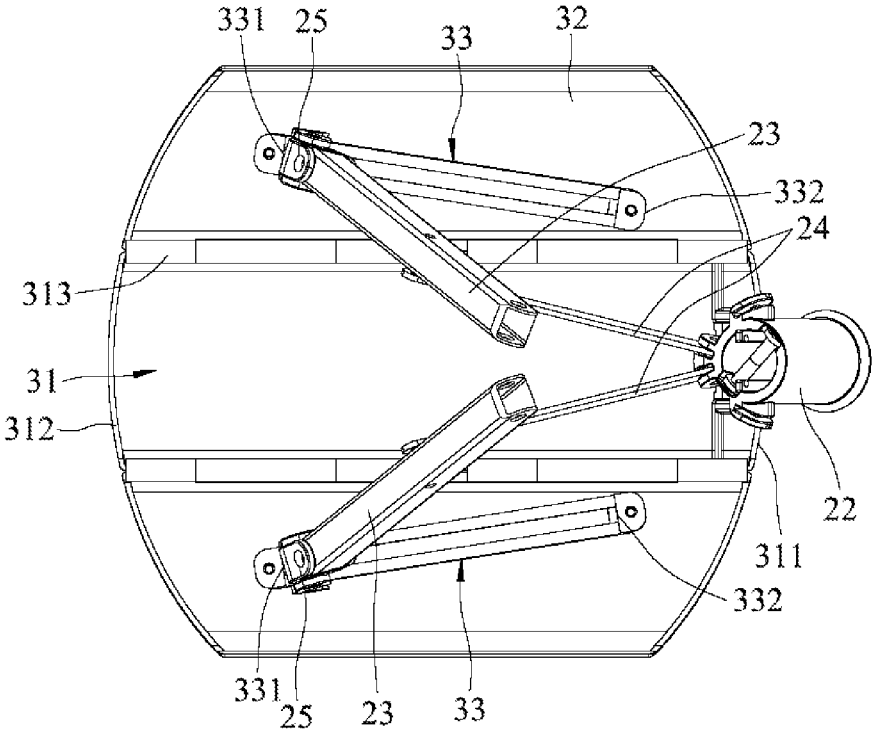
FIG. 5 is a bottom view of the seat unit when the seat unit is in the use state.
Figure 6:
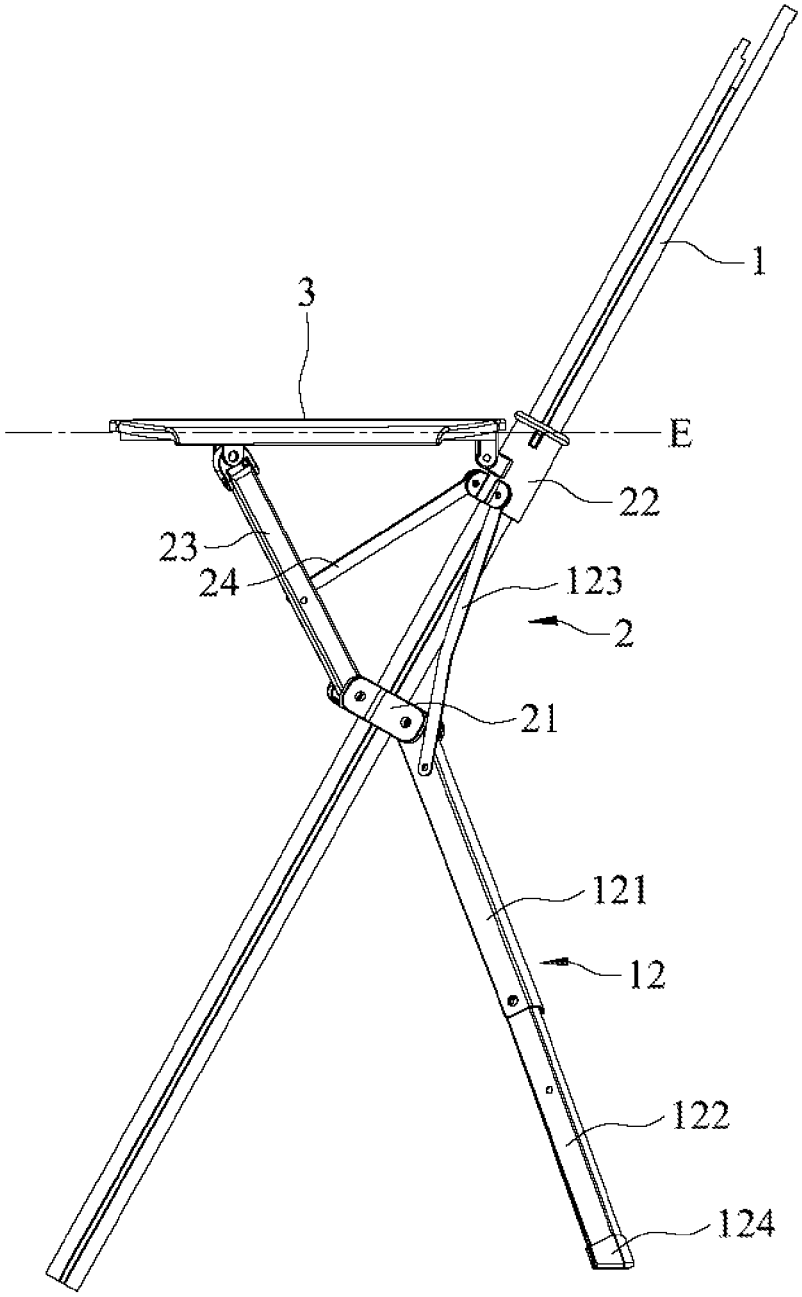
FIG. 6 is a side view of the foldable chair when the seat unit is in the use state.
Figure 7:
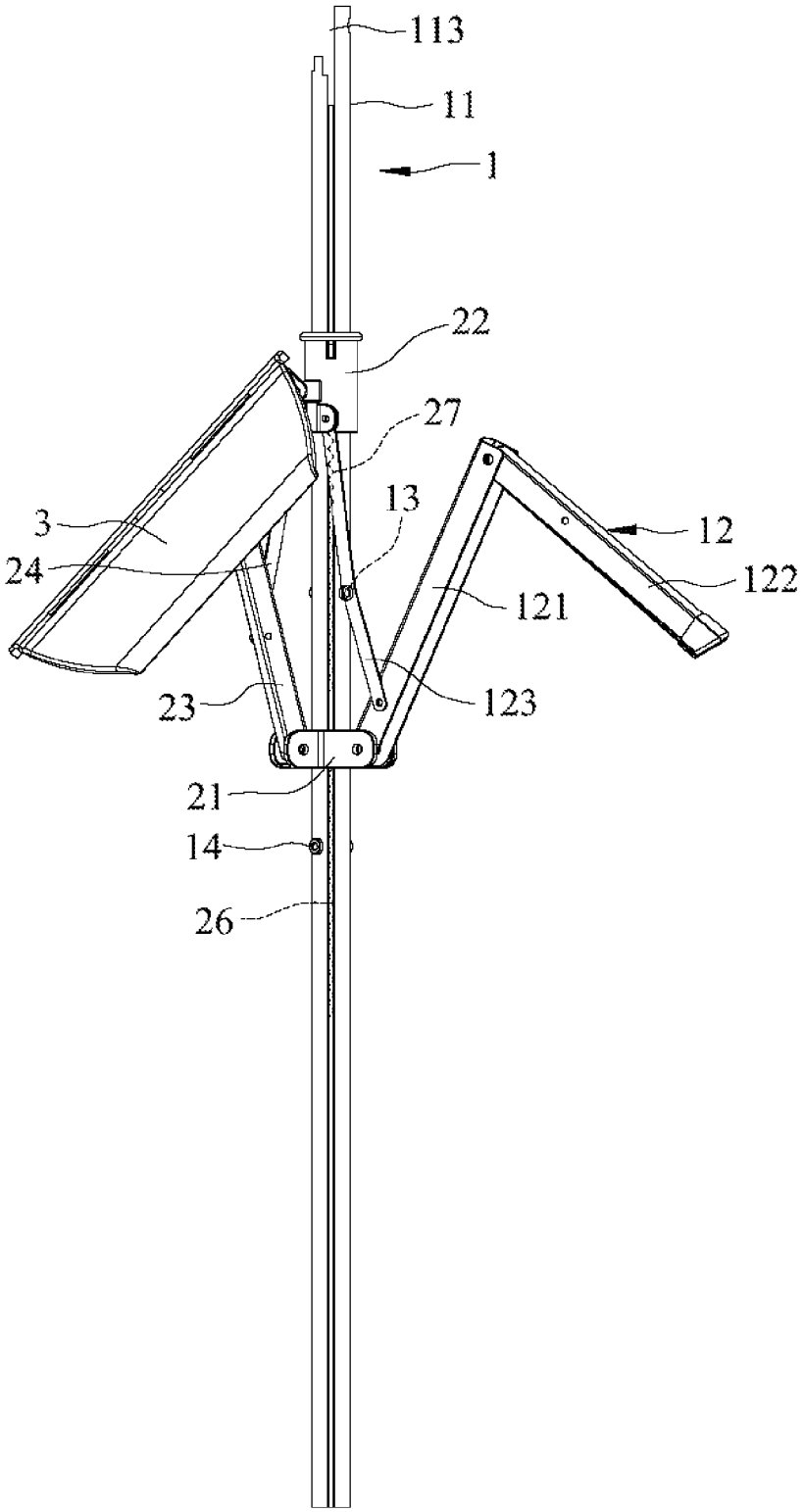
FIG. 7 is similar to FIG. 6, showing that the seat unit is in a state between the use state and the collapsed state.

The seat unit 3 includes a middle portion 31 and left and right wing portions 32. The middle portion 31 extends in a longitudinal direction (L) to terminate at a forward edge 312 and a rearward edge 311 which is pivotally connected to the collar sleeve 22. Each of the left and right wing portions 32 is hinged to the middle portion 31 along a hinge line 313, and is juxtaposed with the middle portion 31 along the respective hinge line 313. When the collar sleeve 22 is displaced from the distal position to the proximate position, the seat unit 3 is convertible from a use state, where the middle portion 31 is coplanar with the left and right wing portions 32 (as best shown in FIGS. 1, 5 and 6), to a collapsed state, where the middle portion 31 is at an included angle with each of the left and right wing portions 32 (as best shown in FIGS. 2 and 4).

Each of the two keyways 33 is disposed on an under surface of a corresponding one of the left and right wing portions 32, and extends along the longitudinal direction (L) to terminate at front and rear keyway ends 331, 332. The front keyway end 331 is disposed remote from the respective hinged line 313, and the rear keyway end 332 is disposed close to the respective hinged line 313 so as to facilitate conversion of the seat unit 3 from the use state to the collapsed state.

Each of the two bracing bars 23 has a pivot end 231 pivotally connected to the carrier 21, and a key end 232 configured to be slidably engaged with a corresponding one of the keyways 33 such that when the key end 232 slides from the respective front keyway end 331 to the respective rear keyway end 332, the seat unit 3 is transformed from the use state to the collapsed state.

Each of the two prop legs 12 has a bottom end 124 for standing on the ground, and a pivoted end 125 pivotally connected to the carrier 21. The prop legs 12 are convertible between a straddling position (FIGS. 1 and 6), where the bottom ends 124 of the prop legs 12 are remote from the stick shank 11, and an upheld position (FIGS. 2 and 4), where the bottom ends 124 are close to the stick shank 11. When the collar sleeve 22 is displaced from the distal position to the proximate position, the prop legs 12 are permitted to move from the straddling position to the upheld position.

As best shown in FIGS. 1 and 6, when the foldable chair is used as a chair, i.e., when the seat unit 3 is in the use state, the bracing bars 23 and the prop legs 12 are opposite to each other relative to the stick shank 11.

In this embodiment, each of the prop legs 12 includes upper and lower segments 121, 122 which are linked to each other. The upper segment 121 has the respective pivoted end 125, and the lower segment 122 has the respective bottom end 124. When the prop legs 12 are in the straddling position, the upper and lower segments 121, 122 are in an unfolded state, and when the prop legs 12 are in the upheld position, the upper and lower segments 121, 122 are in a folded state.

The first and second retaining members 13, 14 are respectively disposed to prevent the collar sleeve 22 and the carrier 21 from moving toward the foot end 114 and to retain the collar sleeve 22 and the carrier 21 at the distal and lower positions, respectively.

Preferably, the foldable chair further includes a third retaining member 28 which is disposed to prevent the collar sleeve 22 from moving toward the foot end 114 and to permit the collar sleeve 22 to be retained at the proximate position.

As shown in FIG. 1, the foldable chair further includes first and second biasing members 27, 26. The first biasing member 27 is disposed to bias the collar sleeve 22 toward the first retaining member 13 by virtue of a first biasing force. The second biasing member 26 is disposed to bias the carrier 21 toward the second retaining member 14 by virtue of a second biasing force. When the collar sleeve 22 is subjected to a manual pulling force and is thereby displaced to a first transit position (not shown), where the manual pulling force counteracts the first and second biasing forces and gravity of the carrier 21 and the collar sleeve 22, the seat unit 3 is convertible from the use state to the collapsed state, and such that when the collar sleeve 22 is subsequently displaced to the proximate position and is retained thereat by the third retaining member 28, the carrier 21 is displaced to the upper position.

The stick shank 11 is formed with a lengthwise-extending groove 111. The first biasing member 27 is disposed in the lengthwise-extending groove 111 and has two ends respectively connected to the collar sleeve 22 and a groove-defining wall at a first position that is located between the first and second retaining members 13, 14. The second biasing member 26 is also disposed in the lengthwise-extending groove 111, and has two ends respectively connected to the carrier 21 and the groove-defining wall at a second position that is located between the second retaining member 14 and the foot end 114. In this embodiment, the stick shank 11 is formed with four lengthwise-extending grooves 111 which are angularly displaced apart from each other, and each of which has the first and second biasing members 27, 26.

Referring further to FIG. 1, when the seat unit 3 is in the use state for sitting, the collar sleeve 22 is displaced to the distal position, the carrier 21 is displaced to the lower position, the key end 232 of each bracing bar 23 is slid to the respective front keyway end 331, and the prop legs 12 are displaced to the straddling position.

Referring further to FIGS. 2 and 4, when the seat unit 3 is in the collapsed state for assisting walking, the collar sleeve 22 is displaced to the proximate position, the carrier 21 is displaced to the upper position, the key end 232 of each bracing bar 23 is slid to the respective rear keyway end 332, and the prop legs 12 are displaced to the upheld position.

Figure 12:
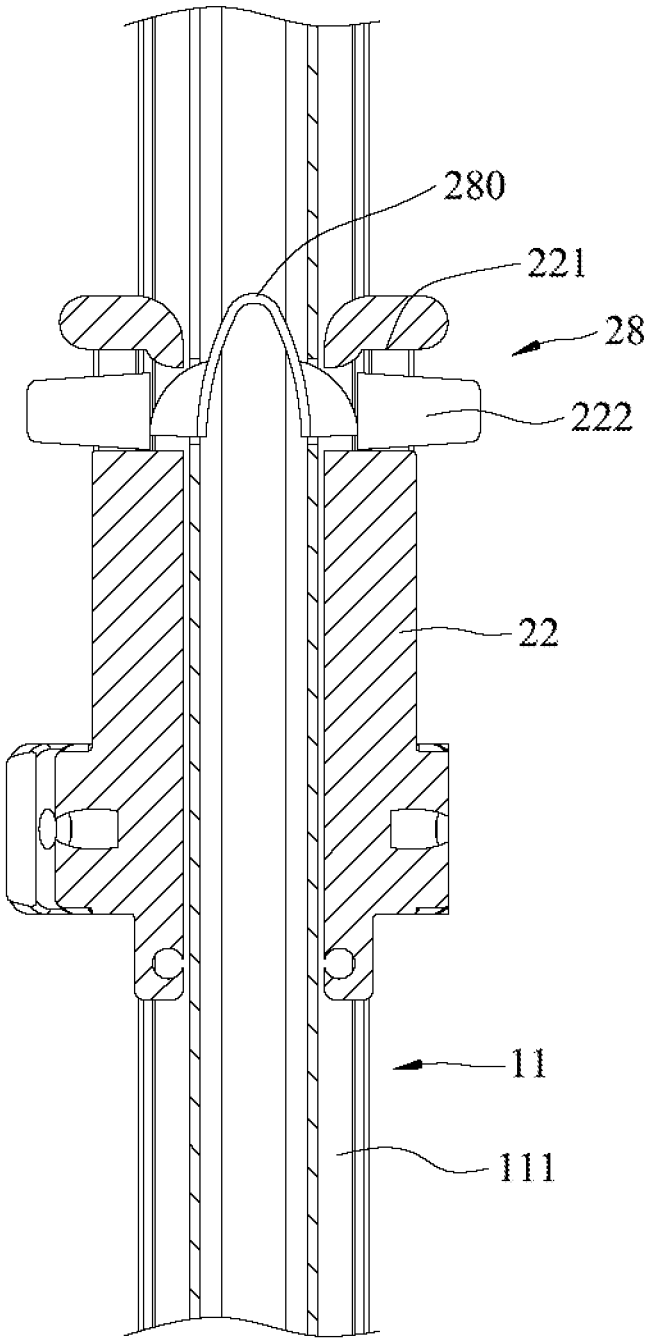
FIG. 12 is a fragmentary partly sectional view of the foldable chair, showing a third retaining member for retaining a collar sleeve in a proximate position.

Referring to FIG. 12, in this embodiment, the collar sleeve 22 is formed with a hole 221, and the third retaining member 28 includes a button 222 and a biasing spring 280 which is disposed to urge the button 222 to extend outwardly of the stick shank 11 such that the button 222 is permitted to extend through the hole 221 of the collar sleeve 22 when the collar sleeve 22 is displaced to the proximate position to thereby retain the collar sleeve 22 thereat. To release the collar sleeve 22, it is simply necessary to press the button 222 to disengage the button 222 from the hole 221.

Referring further to FIG. 1, the foldable chair further includes two strut members 24 and two linking members 123.

Each of the strut members 24 has a sleeve-side end 241 pivotally connected to the collar sleeve 22, and a bar-side end 242 pivotally connected to a corresponding one of the bracing bars 23 between the respective pivot end 231 and the respective key end 232 so as to facilitate sliding of the respective key end 232 between the respective front and rear keyway ends 331, 332. Furthermore, a distance between the bar-side end 242 and the respective pivot end 231 is slightly shorter than a distance between the bar-side end 242 and the respective key end 232.

Each linking member 123 has an upper linking end 126 pivotally connected to the collar sleeve 22, and a lower linking end 127 pivotally connected to the respective pivoted end 125 so as to facilitate displacement of each of the prop legs 12 between the straddling position and the upheld position.

Referring back to FIGS. 2 and 4, the seat unit 3 is configured such that, when in the collapsed state, the left and right wing portions 32 are disposed angularly about the stick shank 11 and define a gap 30 therebetween. The gap 30 is opposite to the middle portion 31 relative to the stick shank 11, and is configured to accommodate the prop legs 12 therein when the prop legs 12 are displaced to the upheld position. In addition, when the seat unit 3 is converted to the collapsed state, the bracing bars 23 and the strut members 24 are accommodated in a space between the middle portion 31 and the stick shank 11. Hence, when a person uses the foldable chair with the seat unit 3 in the collapsed state for assisting walking, he/she is less likely to get hurt by the foldable chair.

Figure 8:
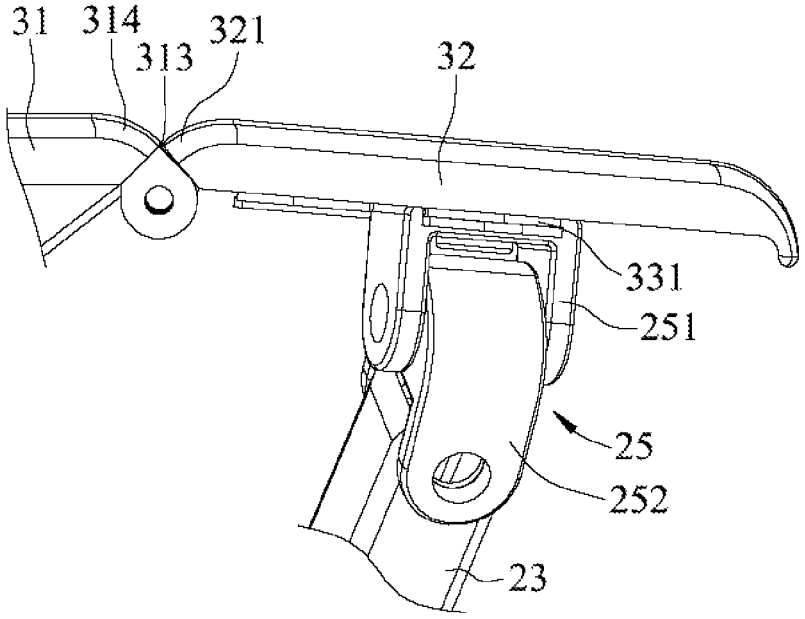
FIG. 8 is a fragmentary view of the seat unit when the seat unit is in the use state.

In this embodiment, referring to FIG. 8, the middle portion 31 extends to terminate at left and right margins 314 (only one is shown) that are adjacent to the left and right wing portions 32 and that are rounded. Each of the left and right wing portions 32 extends to terminate at a connection margin 321 (only one is shown) that is rounded. When a user is going to seat on the seat unit 3 to make the seat unit 3 to be fully transformed into the use state, his/her clothes is less likely to be clamped by a slit among the middle portion 31 and the left and right wing portions 32.

Figure 10:
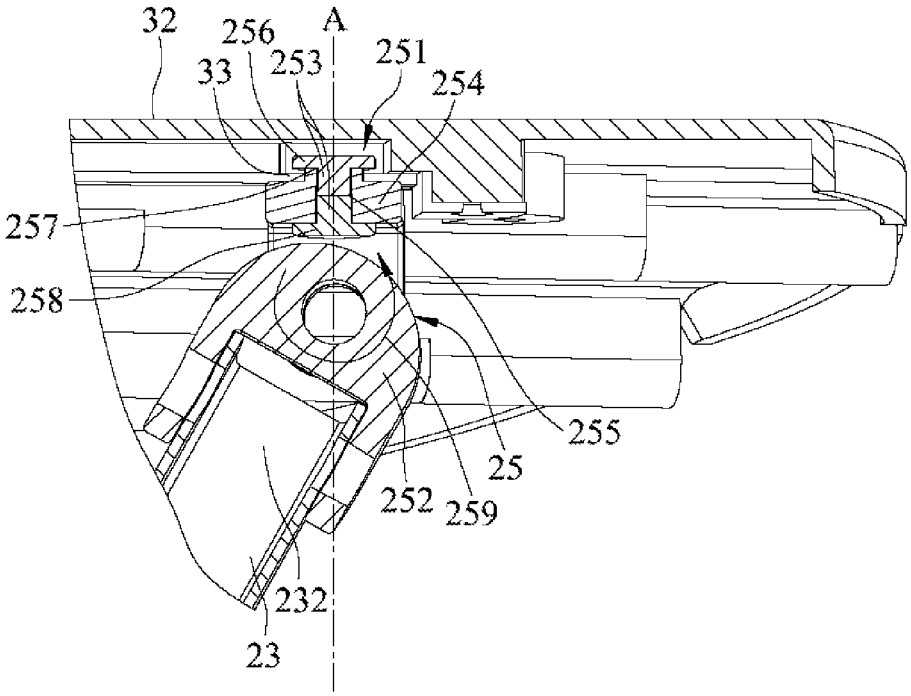
FIG. 10 is a fragmentary partly sectional view of the foldable chair, showing a key assembly and a keyway in an engaged state.
Figure 11:
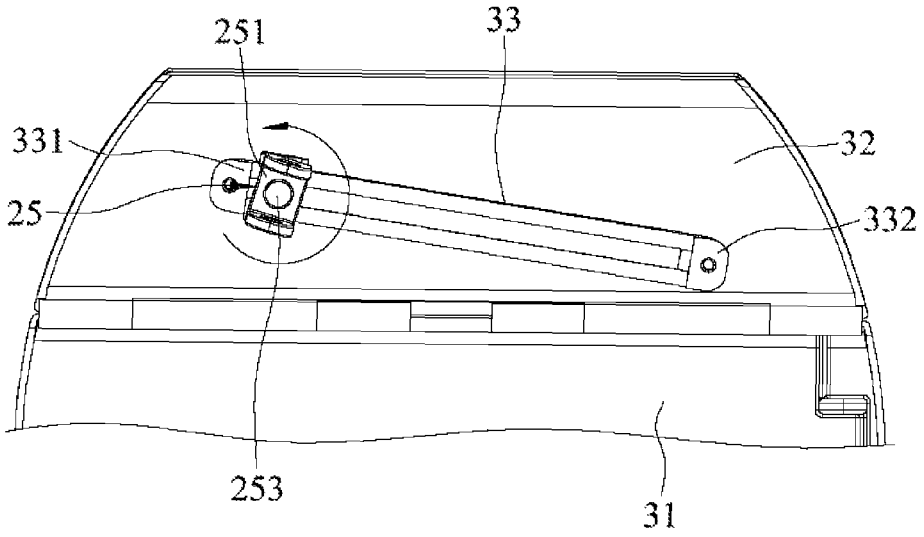
FIG. 11 is a fragmentary bottom view of the seat unit.

In addition, referring to FIGS. 8, 10 and 11, the foldable chair further includes two key assemblies 25, each of which includes an engageable key unit 251 and a pivotable key unit 252. The engageable key unit 251 is configured to be slidably engaged with the corresponding one of the keyways 33. The pivotable key unit 252 is configured to be pivotally connected to the engageable key unit 251 about a pivot axis, and is pivotally connect to the key end 232 of the corresponding one of the bracing bars 23. The pivot axis is surrounded by a curved arrow 259 shown in FIG. 10.

The engageable key unit 251 includes a key stem 253, a key seat 254, and a key head 256. The key seat 254 is formed with an insertion hole 255. The key stem 253 extends in a lengthwise axis (A) to terminate at a connection end 257 and a free end 258, and is configured to be inserted in the insertion hole 255 so as to permit the key seat 254 to rotate about the lengthwise axis (A) which is perpendicular to the pivot axis. The key head 256 is connected to the connected end 257 of the key stem 253 and is slidably engaged with the corresponding one of the keyways 33.

Figure 9:
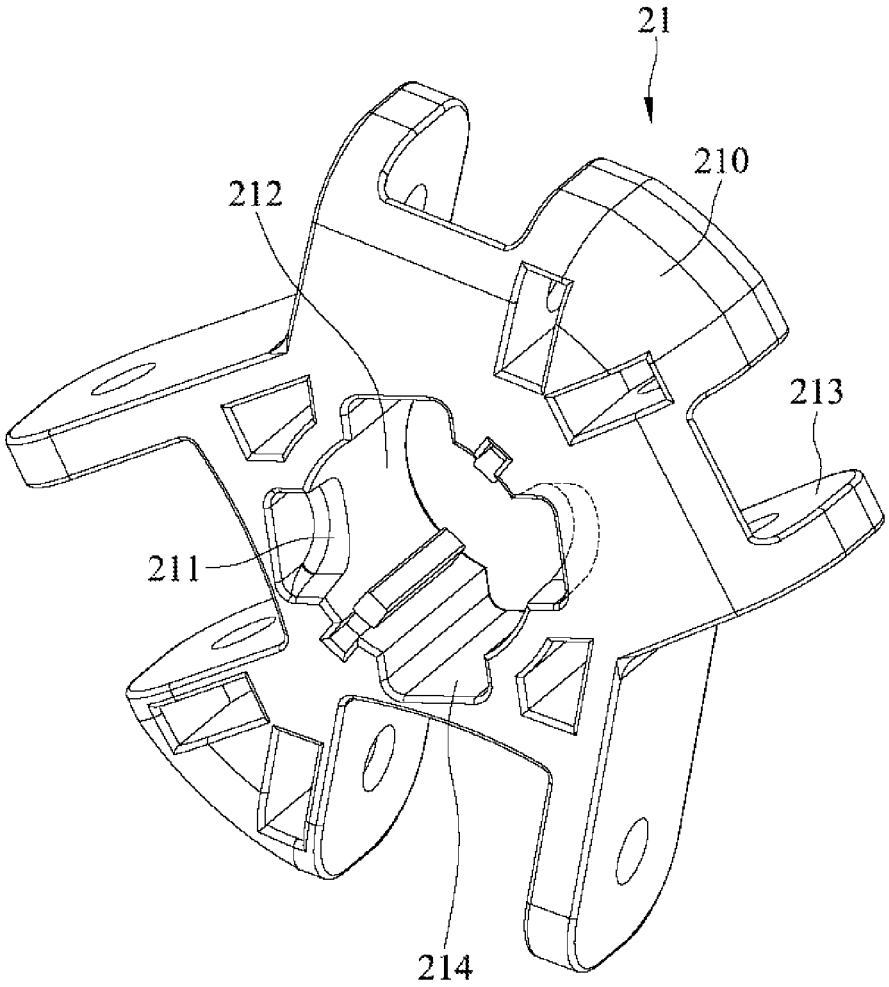
FIG. 9 is a perspective view of a carrier in the foldable chair.

Referring further to FIGS. 1 and 9, in this embodiment, the carrier 21 includes a hub body 210 having an inner tubular surface 212 slidably engaged with the stick shank 11, and an outer anchoring surface 213 which is opposite to the inner tubular surface 212 in radial directions, and which is configured to permit the bracing bars 23 and the prop legs 12 to be pivotally connected thereto. In this embodiment, the second retaining member 14 has a dimension larger than that of the first retaining member 13. The inner tubular surface 212 is configured to have a groove region 214 for passage of the first retaining member 13 therethrough and a raised region 211 that abuts against the second retaining member 14 when the carrier 21 is displaced to the lower position.

Figure 13:
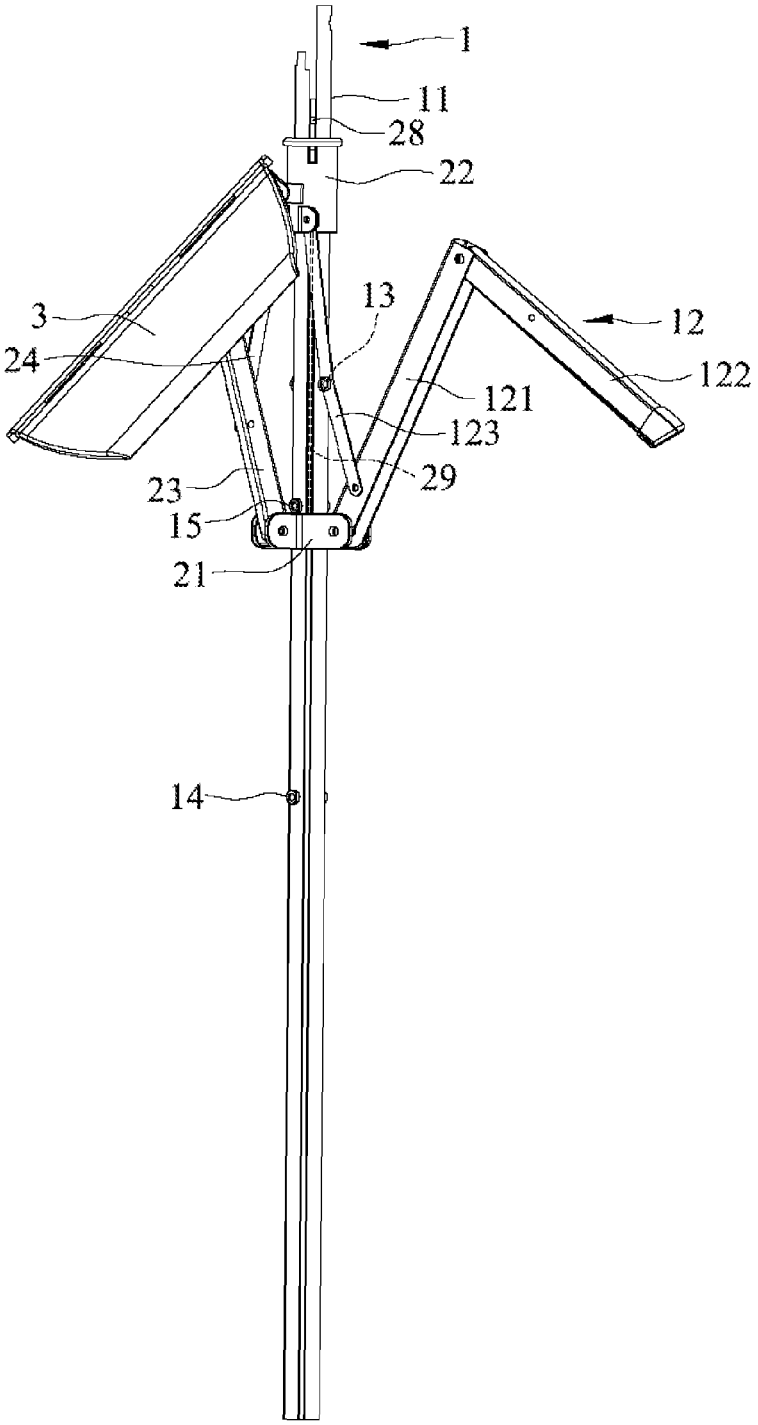
FIG. 13 is a side view of a foldable chair according to a second preferred embodiment of this disclosure, where a seat unit is in a state between a use state and a collapsed state.

FIG. 13 illustrates a foldable chair according to a second embodiment of this disclosure. The second embodiment differs from the first embodiment in that, in the second embodiment, the first and second biasing members 27, 26 are omitted. In the second embodiment, the chair-convertible foldable chair further includes a fourth retaining member 15 and a third biasing member 29. The fourth retaining member 15 is disposed to retain the carrier 21 at the upper position. The third biasing member 29 is disposed to bias the collar sleeve 22 toward the carrier 21 by a third biasing force. When the collar sleeve 22 is subjected to a manual pulling force to be thereby displaced to a second transit position, where the manual pulling force counteracts the third biasing force and gravity of the carrier 21 and the collar sleeve 22, the carrier 21 is displaced to the upper position and retained thereat by the fourth retaining member 15. When the collar sleeve 22 is subsequently displaced to the proximate position and to be retained by the third retaining member 28, the seat unit 3 is converted from the use state to the collapsed state.

In this embodiment, the third biasing member 29 is disposed to be connected between the collar sleeve 22 and the carrier 21 so as to bias the collar sleeve 22 toward the carrier 21.

Figure 14:
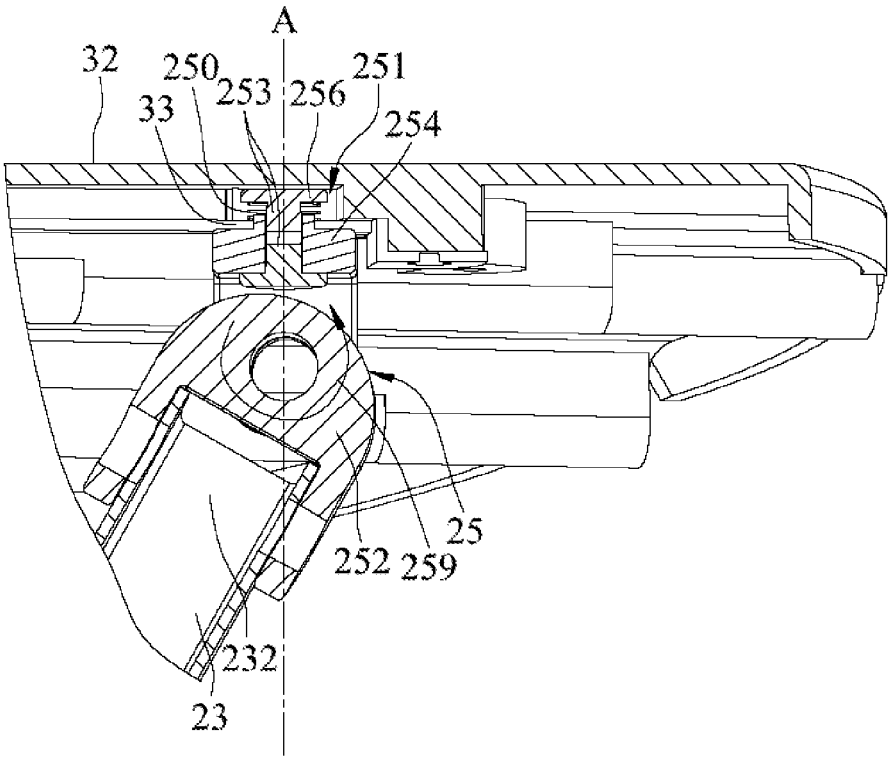
FIG. 14 is a fragmentary cross-sectional view of a foldable chair according to a third embodiment of this disclosure.

FIG. 14 is a fragmentary cross-sectional view of a foldable chair according to a third embodiment of this disclosure. In this embodiment, the engageable key unit 251 further includes a fourth biasing member 250, and the key head 256 is displaceable between a first key position, where the key head 256 is in a high-friction engagement with the corresponding one of the keyways 33, and a second key position, where the key head 256 is in a low-friction engagement with the corresponding one of the keyways 33. The fourth biasing member 250 is sleeved on the key stem 253 and is disposed between the key seat 254 and said key head 256 to bias the key head 256 to the first key position. Thus, by virtue of the biasing action of the fourth biasing member 250 which urges the key head 256 to abut against the corresponding one of the keyways 33, when the seat unit 3 is converted to the collapsed state, undesired wobbling movement of the key head 256 of each of the key assemblies 25 relative to the corresponding one of the keyways 33 can be prevented.

Figure 15:
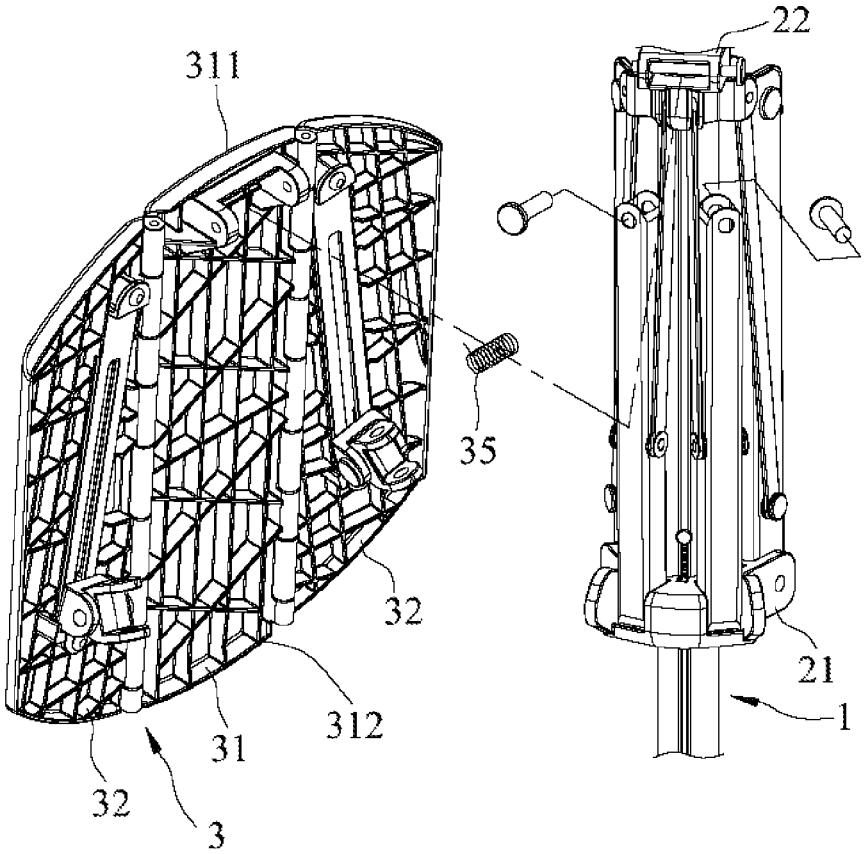
FIG. 15 is an exploded view, showing a fifth biasing member in a foldable chair according to a fourth embodiment of this disclosure.

FIG. 15 illustrates a portion of a foldable chair according to a fourth embodiment of this disclosure. In this embodiment, the foldable chair further includes a fifth biasing member 35.

The fifth biasing member 35 is disposed adjacent to the rearward edge 311 of the middle portion 31 of the seat unit 3 to bias the seat unit 3 from the collapsed state to the use state.

It is noted that, in a variation of each of the first to fourth embodiments, the prop legs 12 and the linking members 123 are omitted, the carrier 21 is sleeved fixedly on the stick shank 11, the stick shank 11 is fixed uprightly to the ground, and the middle portion 31 and the left and right wing portions 32 of the seat unit 3 are located on a plane that is perpendicular to the stick shank 11 when the seat unit 3 is in the use state. The foldable chair of the variation of each of the first to fourth embodiments can be used in mass transportation and public places.

While the present disclosure has been described in connection with what are considered the most practical embodiments, it is understood that this disclosure is not limited to the disclosed embodiments but is intended to cover various arrangements included within the spirit and scope of the broadest interpretations and equivalent arrangements.

What is claimed is:

1. A foldable chair, comprising:

a stick shank extending in a lengthwise direction to terminate at a grip end and a foot end;

a collar sleeve sleeved on said stick shank and movable between distal and proximate positions relative to said grip end;

a carrier sleeved on said stick shank;

a seat unit including, a middle portion extending in a longitudinal direction to terminate at a forward edge and a rearward edge which is pivotally connected to said collar sleeve, and left and right wing portions each being juxtaposed with said middle portion along a hinge line, and each being hinged to said middle portion at the respective hinge line such that when said collar sleeve is displaced from the distal position to the proximate position, said seat unit is convertible from a use state, where said middle portion is coplanar with said left and right wing portions, to a collapsed state, where said middle portion is at an included angle with each of said left and right wing portions;

two keyways each being disposed on an under surface of a corresponding one of said left and right wing portions, and each extending along the longitudinal direction to terminate at front and rear keyway ends;

two bracing bars each having a pivot end pivotally connected to said carrier, and a key end configured to be slidably engaged with a corresponding one of said keyways such that when said key end slides from said front keyway end of a respective one of said keyways to said rear keyway end of the respective one of said keyways, said seat unit is converted from the use state to the collapsed state; and two prop legs each extending to terminate at a bottom end for standing on the ground, and a pivoted end pivotally connected to said carrier, said two prop legs being convertible between a straddling position, where said bottom ends of said prop legs are remote from said stick shank, and an upheld position, where said bottom ends are close to said stick shank such that when said collar sleeve is displaced from the distal position to the proximate position, said prop legs are permitted to move from the straddling position to the upheld position.

2. The foldable chair of claim 1, further comprising two strut members each having a sleeve-side end pivotally connected to said collar sleeve, and a bar-side end pivotally connected to a corresponding one of said bracing bars between said pivot end and said key end of the corresponding one of said bracing bars so as to facilitate sliding of said key end between said front and rear keyway ends of the respective one of said keyways.

3. The foldable chair of claim 2, wherein said carrier is configured to be slidable on said stick shank and movable between upper and lower positions, said foldable chair further comprising first and second retaining members respectively disposed to prevent said collar sleeve and said carrier from moving toward said foot end and to permit said collar sleeve and said carrier to be retained at the distal and lower positions, respectively.

4. The foldable chair of claim 3, further comprising a third retaining member disposed to prevent said collar sleeve from moving toward said foot end and to permit said collar sleeve to be retained at the proximate position.

5. The foldable chair of claim 4, further comprising, a third biasing member disposed to bias said collar sleeve toward said carrier with a third biasing force, such that when said collar sleeve is subjected to a manual pulling force to be thereby displaced to a second transit position, where the manual pulling force counteracts the third biasing force, said carrier is displaced to the upper position, and such that when said collar sleeve is subsequently displaced to the proximate position and is retained thereat by said third retaining member, said seat unit is converted from the use state to the collapsed state.

6. The foldable chair of claim 2, wherein said front keyway end is disposed remote from the respective hinged line, and said rear keyway end is disposed close to the respective hinged line so as to facilitate conversion of said seat unit from the use state to the collapsed state.

7. The foldable chair of claim 2, further comprising two key assemblies each of which includes an engageable key unit configured to be slidably engaged with the corresponding one of said keyways, and a pivotable key unit which is configured to be pivotally connected to said engageable key unit about a pivot axis, and which is configured to be pivotally connected to said key end of the corresponding one of said bracing bars.

8. The foldable chair of claim 7, wherein said engageable key unit includes:

a key seat formed with an insertion hole, a key stem extending in a lengthwise axis to terminate at a connected end and a free end, and configured to be inserted in said insertion hole so as to permit said key seat to rotate about the lengthwise axis which is perpendicular to the pivot axis, a key head connected to said connected end of said key stem and displaceable between a first key position, where said key head is in a high-friction engagement with the corresponding one of said keyways, and a second key position, where said key head is in a low-friction engagement with the corresponding one of said keyways, and a fourth biasing member sleeved on said key stem and disposed between said key seat and said key head to bias said key head to the first key position.

9. The foldable chair of claim 2, wherein each of said prop legs includes upper and lower segments which are linked to each other, and which respectively have said pivoted end and said bottom end, such that when said prop legs are in the straddling position, said upper and lower segments are in an unfolded state, and when said prop legs are in the upheld position, said upper and lower segments are in a folded state.

10. The foldable chair of claim 9, further comprising two linking members each having an upper linking end pivotally connected to said collar sleeve, and a lower linking end pivotally connected to said pivoted end of a respective one of said prop legs so as to facilitate displacement of each of said prop legs between the straddling position and the upheld position.

11. The foldable chair of claim 9, wherein said seat unit is configured such that when in the collapsed state, said left and right wing portions are disposed angularly about said stick shank and define a gap therebetween, said gap being opposite to said middle portion relative to said stick shank, and being configured to accommodate said prop legs therein when said prop legs are displaced to the upheld position.

12. The foldable chair of claim 2, wherein said carrier is configured to be slidable on said stick shank and movable between upper and lower positions, and includes a hub body having an inner tubular surface slidably engaged with said stick shank, and an outer anchoring surface which is opposite to said inner tubular surface in radial directions, and which is configured to permit said bracing bars and said prop legs to be pivotally connected thereto.

13. The foldable chair of claim 12, wherein said bracing bars and said prop legs are opposite to each other relative to said stick shank, when the seat unit is in the use state.

14. The foldable chair of claim 12, wherein said inner tubular surface is configured to have a groove region for passage of said first retaining member therethrough and a raised region that abuts against said second retaining member when said carrier is displaced to the lower position.

15. The foldable chair of claim 2, wherein said carrier is configured to be slidable on said stick shank and movable between upper and lower positions, said foldable chair further comprising first and second retaining members respectively disposed to prevent said collar sleeve and said carrier from moving toward said foot end and to permit said collar sleeve and said carrier to be retained at the distal and lower positions, respectively, and a fifth biasing member disposed adjacent to said rearward edge of said middle portion of said seat unit to bias said seat unit from the collapsed state to the use state.

16. A foldable chair, comprising:

a stick shank extending in a lengthwise direction to terminate at a grip end and a foot end;

a collar sleeve sleeved on said stick shank and movable between distal and proximate positions relative to said grip end;

a carrier sleeved on said stick shank;

a seat unit including, a middle portion extending in a longitudinal direction to terminate at a forward edge and a rearward edge which is pivotally connected to said collar sleeve, and left and right wing portions each being juxtaposed with said middle portion along a hinge line, and each being hinged to said middle portion at the respective hinge line such that when said collar sleeve is displaced from the distal position to the proximate position, said seat unit is convertible from a use state, where said middle portion is coplanar with said left and right wing portions, to a collapsed state, where said middle portion is at an included angle with each of said left and right wing portions;

two keyways each being disposed on an under surface of a corresponding one of said left and right wing portions, and each extending along the longitudinal direction to terminate at front and rear keyway ends; and two bracing bars each having a pivot end connected to said carrier, and a key end configured to be slidably engaged with a corresponding one of said keyways such that when said key end slides from said front keyway end of a respective one of said keyways to said rear keyway end of the respective one of said keyways, said seat unit is converted from the use state to the collapsed state.

17. The foldable chair of claim 16, further comprising two strut members each having a sleeve-side end pivotally connected to said collar sleeve, and a bar-side end pivotally connected to a corresponding one of said bracing bars between said pivot end and said key end of the corresponding one of said bracing bars so as to facilitate sliding of said key end between said front and rear keyway ends of the respective one of said keyways.

18. The foldable chair of claim 17, further comprising two key assemblies each of which includes an engageable key unit configured to be slidably engaged with the corresponding one of said keyways, and a pivotable key unit which is configured to be pivotally connected to said engageable key unit about a pivot axis, and which is configured to be pivotally connected to said key end of the corresponding one of said bracing bars.

19. The foldable chair of claim 17, further comprising a fifth biasing member disposed adjacent to said rearward edge of said middle portion of said seat unit to bias said seat unit from the collapsed state to the use state.

20. The foldable chair of claim 17, wherein said carrier is configured to be slidable on said stick shank and movable between upper and lower positions, said foldable chair further comprising, a third biasing member disposed to bias said collar sleeve toward said carrier with a third biasing force, such that when said collar sleeve is subjected to a manual pulling force to be thereby displaced to a second transit position, where the manual pulling force counteracts the third biasing force, said carrier is displaced to the upper position, and such that when said collar sleeve is subsequently displaced to the proximate position and is retained thereat, said seat unit is converted from the use state to the collapsed state.

* * * * *